United States Patent [19]

Mattila

[11] Patent Number: 4,593,517

[45] Date of Patent: Jun. 10, 1986

[54] METHOD AND APPARATUS FOR PACKING GOODS

[76] Inventor: Jari Mattila, Kotimäentie 6, Loimaa, Finland

[21] Appl. No.: 726,104

[22] Filed: Apr. 23, 1985

Related U.S. Application Data

[63] Continuation-in-part of Ser. No. 342,009, Jan. 6, 1982, abandoned.

[51] Int. Cl.[4] ..... B65B 35/50

[52] U.S. Cl. ..... 53/441; 53/443; 53/535; 53/537; 53/556

[58] Field of Search ..... 53/399, 441, 465, 443, 53/556, 589, 588, 535, 536, 537, 540

[56] References Cited

U.S. PATENT DOCUMENTS

| | | | |
|---|---|---|---|
| 3,119,213 | 1/1964 | Kinney | 53/447 |
| 3,531,905 | 10/1970 | Omori | 53/447 |
| 3,994,114 | 11/1976 | Nishimura | 53/447 X |
| 4,050,220 | 9/1977 | Lancaster et al. | 53/556 |
| 4,060,957 | 12/1977 | Birkenfeld et al. | 53/447 X |
| 4,067,174 | 1/1978 | Goldstein | 53/556 |
| 4,216,640 | 8/1980 | Kaufman | 53/556 |
| 4,550,549 | 11/1985 | Reinfeld et al. | 53/447 |

*Primary Examiner*—Horace M. Culver
*Attorney, Agent, or Firm*—McGlew and Tuttle

[57] ABSTRACT

Packing method and apparatus for packing consumer packages directly onto a pallet. First the packages are arranged to form a load layer on a support plate, which plate and load layer is supported at its sides by a guide plate. Then the support plate is removed so that the load layer is immediately slid onto the empty pallet located below the support plate or on top of a previous layer located on the pallet. Now the pallet together with its load layer, is lowered the height of one load layer so that the load layers are supported on all sides by the guide frame and as new packages emerge from below the guide frame they are simultaneously wrapped in the final wrapping material. The method can be modified so that after the load layer supported by the guide frame is formed on the support plate, the plate is lowered and removed so that the load layer is slid onto the pallet located at standard height below the support plate or on top of the previous load layer located on the pallet. Thereafter the guide frame is lifted up the height of one load layer and simultaneously the packages are wrapped as before.

10 Claims, 21 Drawing Figures

METHOD AND APPARATUS FOR PACKING GOODS

CROSS REFERENCE TO RELATED APPLICATION

This is a continuation-in-part of Ser. No. 342,009 filed Jan. 6, 1982 and now abandoned.

FIELD AND BACKGROUND OF THE INVENTION

The present invention relates to a method for packing consumer packages or their equivalent, directly onto pallets. This invention also relates to an apparatus for applying the aforementioned method.

In the prior art there are known such packing methods where relatively smal consumer packages are packed into so-called group packings, and the group packings further onto pallets. The group packings contain generally 10–20 consumer packages.

Recently, however, the need has arisen to pack consumer packages directly onto pallets which can as such be exposed in supermarkets. In this case group packings cannot be utilized. Moreover, nowadays smaller pallet sizes have gained popularity, for instance 600×800 mm. Pallets of this size are small enough to fit in and out of doors and are easy to handle in general.

The piling of consumer packages or other similar small packages directly onto a pallet is, however, problematical. Normally it is not possible to pile a full layer of small consumer packings onto a pallet and only thereafter wrap the whole pallet, together with the packages with for instance shrink-wrap. Small packages tend to fall off the pallet, wherefore it is necessary to form the separate load layers so that they are piled in a mutually supporting fashion. But the need to vary the piling forms sets up considerable requirements for the packing machine.

From U.S. Pat. No. 3,594,977 issued July 27, 1971 to Grasvoll an apparatus for packing articles in a container is known. The apparatus comprises a conveyor adapted to forward the articles to be packed and pusher means for feeding a row of articles from the conveyor laterally onto a support plate for forming there a load layer, within a guiding frame surrounds the support plate. The support plate is mounted for movement into said container and, when removing it, for sliding the load layer onto the previous load layer. The container is arranged for being lowered down the height of one load layer. But no wrapping of the articles after piling them has been provided.

SUMMARY OF THE INVENTION

The purpose of the present invention is to realize a packing method and an apparatus for applying the method where a pallet full of consumer packages can be wrapped irrespective of the piling form without causing any disorder among the packages.

In order to achieve this the method according to the invention is characterized in that the packages are wrapped with a final wrapping material simultaneously as new packages emerge from below the guide frame and that the wrapping material is spread so quickly that a whole load layer has not totally appeared from below the guide frame before it has already been wrapped. The alternative method according to the invention is characterized in that the guide frame is lifted up the height of one load layer and simultaneously, as new packages emerge from below the support frame, the packages are wrapped in a final wrapping material.

BRIEF DESCRIPTION OF THE DRAWINGS

In the following the invention is explained in detail with reference to the appended drawings, where:

FIG. 4—the consumer packages are conveyed into the apparatus;

FIG. 5—the first row of packages is shifted onto the first support plate;

FIG. 6—the second row of packages is conveyed into the apparatus;

FIG. 7—the second row of packages is shifted onto the first support plate;

FIG. 8—the last row of the load layer is conveyed into the apparatus;

FIG. 9—the whole load layer formed on the first support plate is shifted onto the second support plate;

FIG. 10—the load layer is discharged on top of the previous layer;

FIG. 11—the pallet is lowered downwardly the height of one load layer and the apparatus is ready to start the forming of another load layer;

DESCRIPTION OF THE PREFERRED EMBODIMENTS

Figure 1:
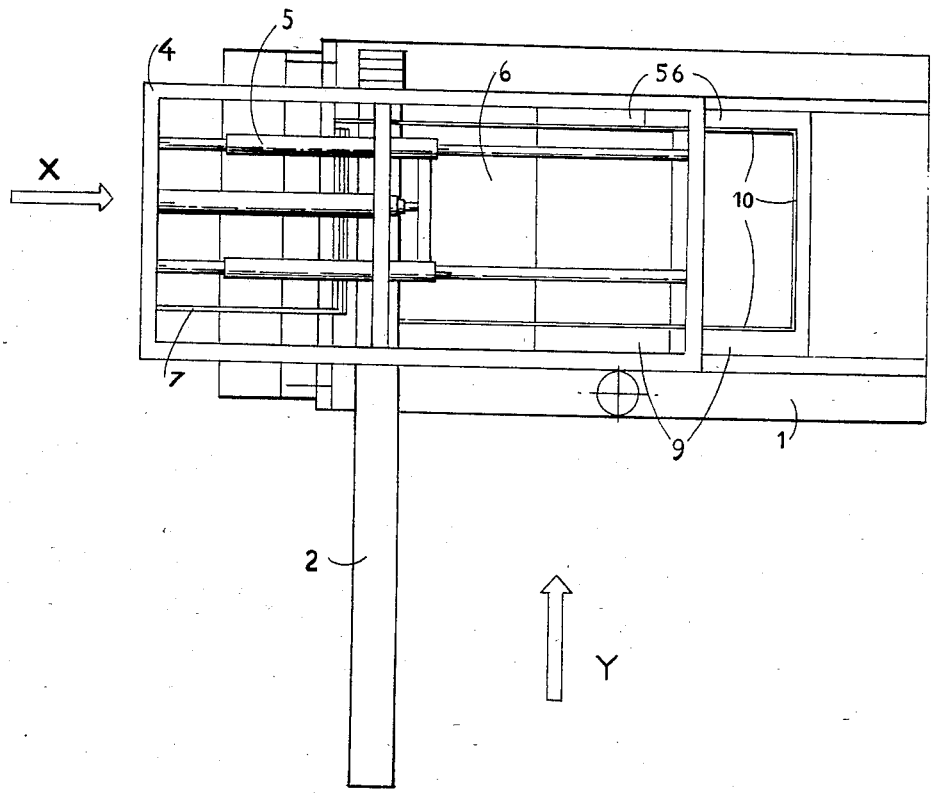
FIG. 1 is a top plan view of the apparatus.
Figure 2:
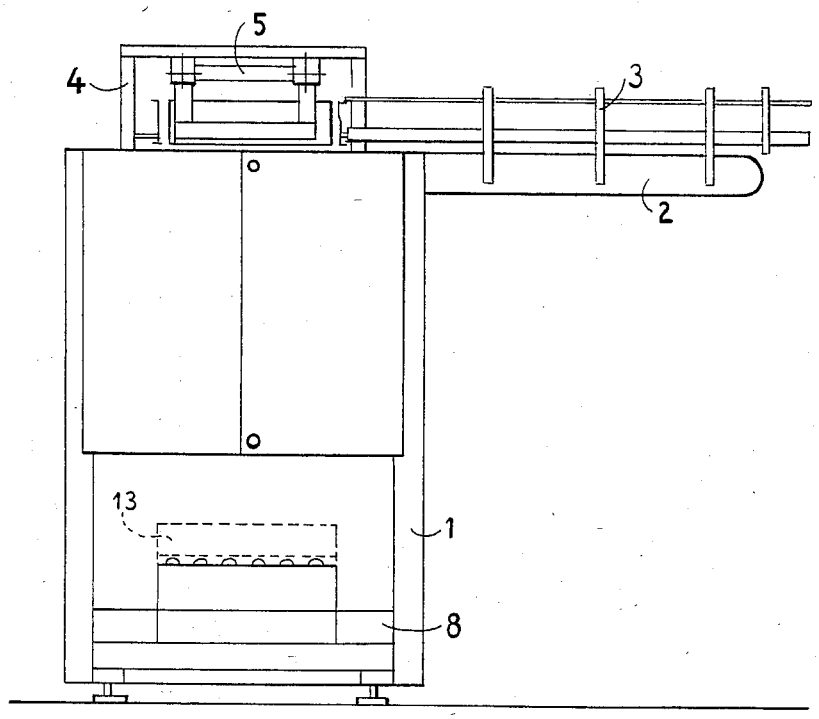
FIG. 2 is a partly broken side elevational view of the apparatus seen from the direction X in FIG. 1.
Figure 3:
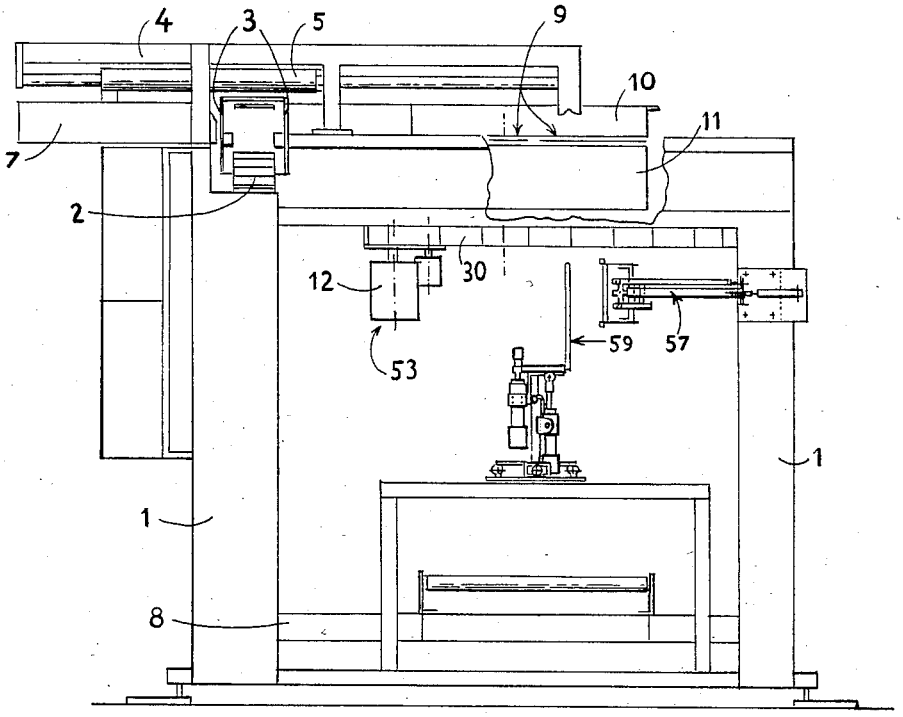
FIG. 3 is a side elevational view of the apparatus seen from the direction Y in FIG. 1.

One preferred embodiment of the invention is described in FIGS. 1–3 and the operation of the embodiment is shown in FIGS. 4–11.

The apparatus of the invention comprises frame 1, a feeding conveyor 2 with first guide plates 3 on one side of the frame 1 and, on the upper part of the frame 1, a thrusting device 5, having a housing 4. The invention includes a first support plate 6, a second support plate 9, a second guide plate 10 and a stationary guide frame 11. In the lower part of a frame 1 the hoisting assembly 8 is provided where a pallet 13 is to be positioned. Further the apparatus comprises a binding device 53 consisting of a roller 12 with wrapping material and a wrapping frame 30. The apparatus is also provided with a cutting and seaming device 57 for the wrapping material and a gripper 59 with its housing.

Figure 5:
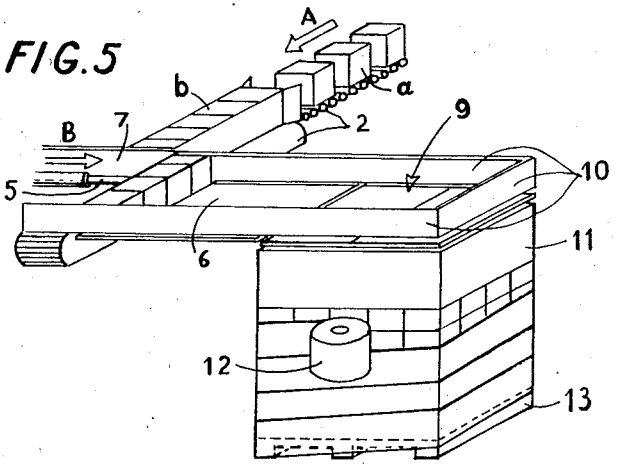
FIGS. 4–11 illustrate the operation of the apparatus according to the successive steps in the packing sequences as follows.

FIGS. 4–11 illustrate in sequences how one load layer is formed. According to FIG. 4, consumer packages a are conveyed forwardly by means of the feeding conveyor 2 in the direction A. With the aid of the guide plates 3, the packages are arranged on the conveyor into a packing line b. From the packing line b, the first row of packages is shifted by means of the thrusting device 5 into the first or intermediate support plate 6 in the direction B (FIG. 5). A side plate 7 of the thrusting device 5 is employed for preventing the packages from sliding to the end of the conveyor path while the thrusting device 5 is in its forward position.

Figure 7:
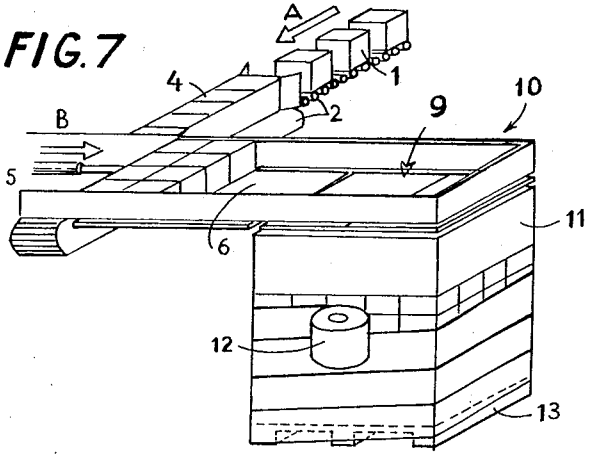
Figure 4:
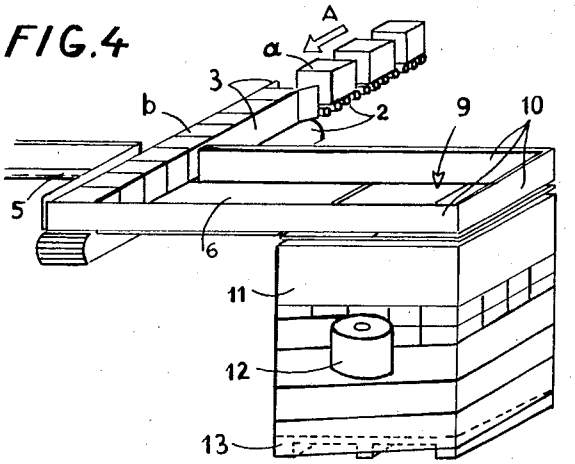
Figure 6:
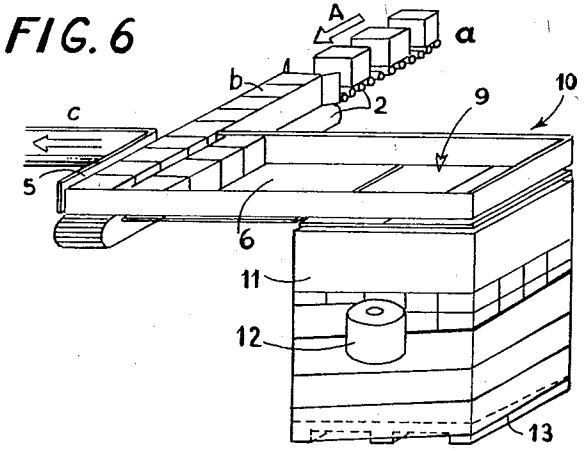
Figure 9:
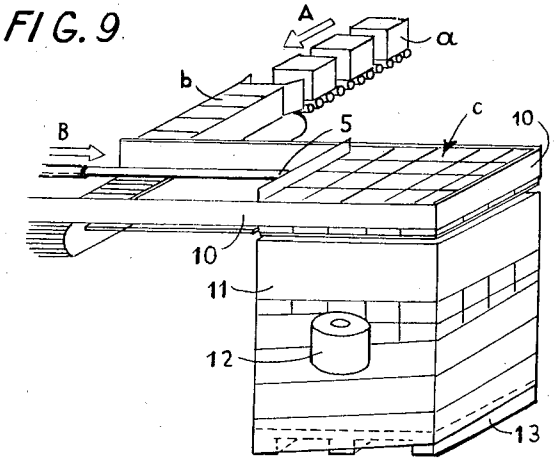

When the thrusting device 5 returns to the starting position (FIG. 6, direction C), the packing line b is again free to move up to the end of the conveyor 2, whereafter the thrusting device 5 performs the shifting of another row of packages onto the intermediate support plate 6 (FIG. 7, direction B). Simultaneously the row of packages already located on the support plate 6 is shifted forwardly the width of one package.

After the shifting operation, the thrusting device 5 is again returned to the starting position, thus allowing the packing line b to move forwardly on the path along the whole length of the path.

By employing the same method, all of the rows of the load layer, except for the last row, are shifted onto the intermediate support plate 6. During the shifting of the last row (FIGS. 8 and 9) the movement of the thrusting device 5 in the direction B reaches so far that the whole load layer c formed on the intermediate support plate 6 is shifted onto the second support plate 9.

The desired form of the load layer c is secured by utilizing the guide plates 10, the position whereof can be adjusted when necessary.

Figure 10:
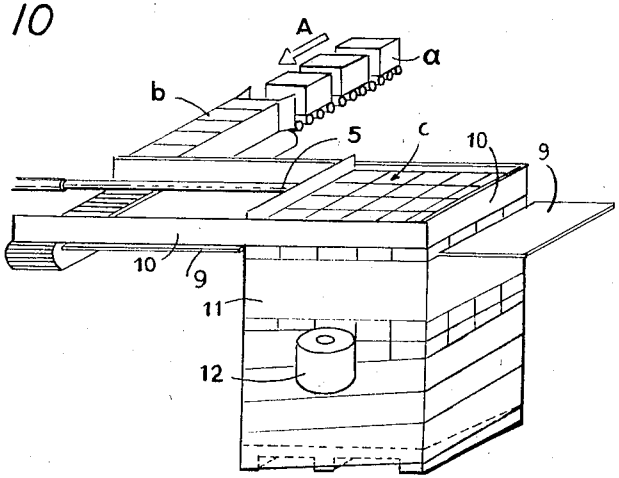

The thrusting device 5 remains in its front position in order to prevent the packages a from shifting when discharged. The load layer is discharged onto an empty pallet or on top of the previous layer by removing the second support plate 9 from under the layer c (FIG. 10). The layer to be discharged is directed to be positioned exactly on top of the previous layer by means of the guide plates 10 and the stationary guide frame 11 or their combination.

Figure 11:
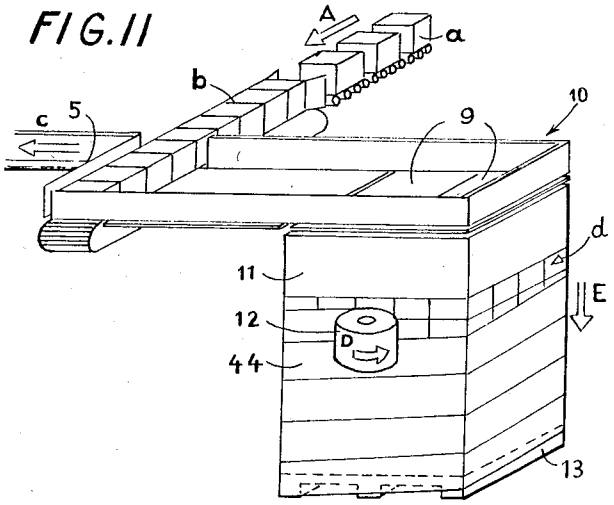
Figure 8:
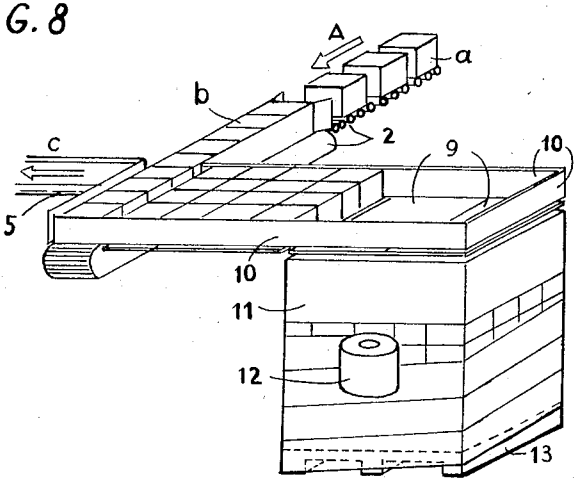

After setting and discharging one load layer, the pallet 13 (FIG. 11) is lowered (direction E) by means of the hoisting device (FIG. 12) downwardly the height of one load layer, whereafter the support plate 9 and the thrusting apparatus 5 return to the starting position (FIG. 11). Now the apparatus is ready to start the forming of another load layer as was explained in connection with FIG. 4.

While the pallet 13 is lowered in the direction E in FIG. 11, the packages of the load layer remain exactly in their proper places owing to the stationary guide frame 11. It is only when the pallet is lowered during the next discharging operation that the whole of the previous layer appears from below the bottom edge of the guide frame 11.

At this stage the operation of the binding device 53 is started (FIG. 11, direction D). The binding device is employed for binding the palleted layer (that is the layer above the previous layer) and comprises (FIG. 15) a roller 12 rotating around a slightly inclined or nearly vertical axis, the roller being provided with the wrapping material 44 for the palleted load. The employed wrapping material 44 can be for instance elastic, band-like plastic foil. The foil is wrapped around the palleted load at the same pace as new load layers appear from under the guide frame 11. The wrapping is carried out so quickly that one layer d (FIG. 11) is not totally released from the grip of the guide frame 11 before the layer is already wrapped. By performing the wrapping operation in this fashion, it is insured that the consumer packages a do not fall off the pallet and that the load layers are not disorganized before the wrapping stage.

Figure 16:
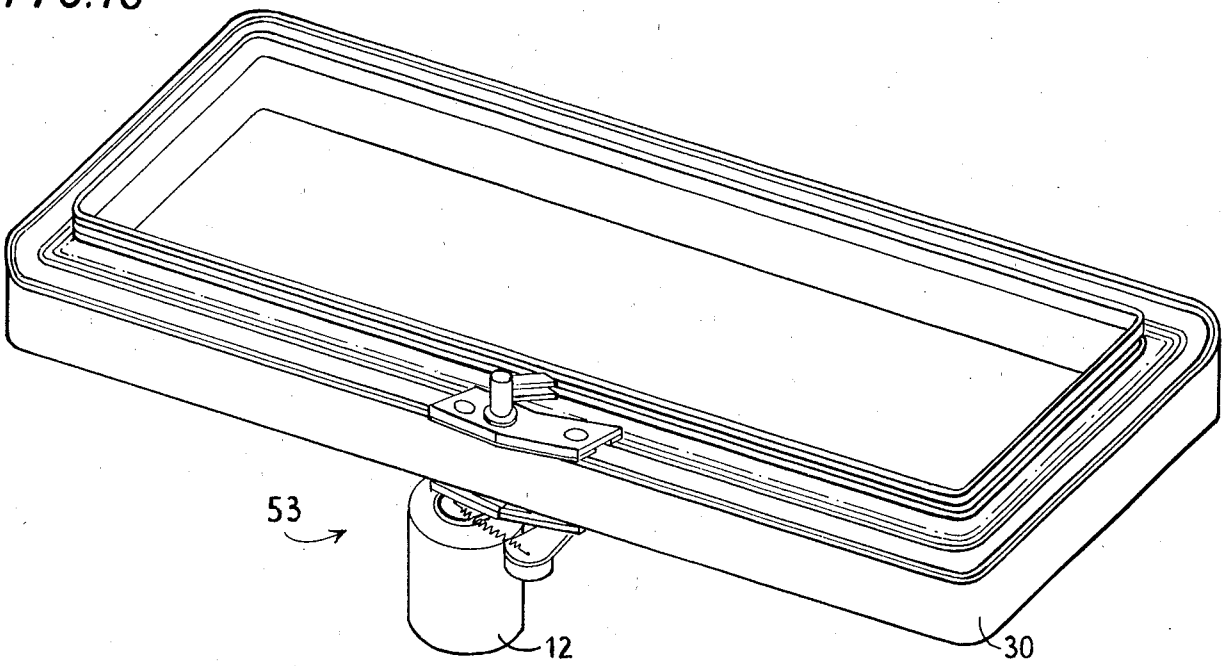
FIG. 16 illustrates the wrapping frame.

The roller 12 moves around the pallet along the guide rail or wrapping frame 30 illustrated in FIG. 16.

When the loading of the pallet and the wrapping of the load are completed, the plastic band which is still connected to the pallet load is cut off. The end of the band is prevented from escaping after cutting by employing the gripper 59 according to FIGS. 18*a* and 18*b*.

Figure 12:
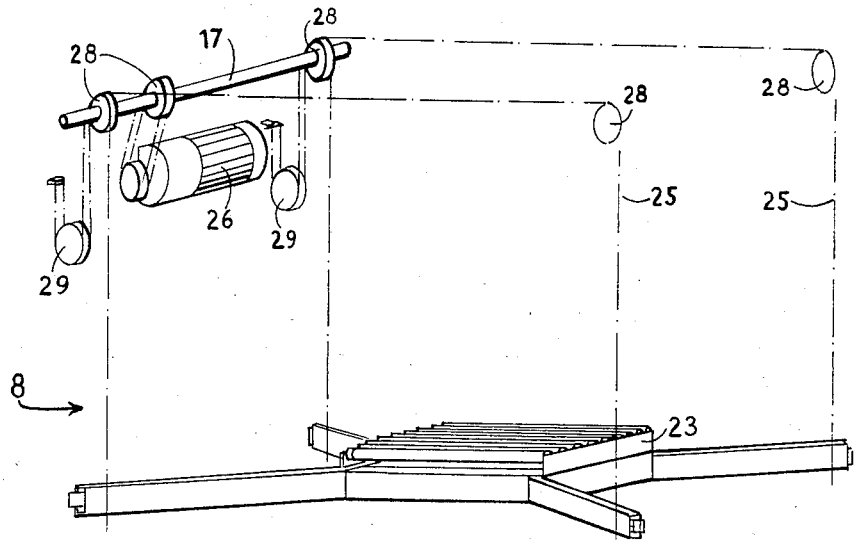
FIG. 12 illustrates the pallet hoisting device.

FIG. 12 shows how the hoisting of the pallet 13 is arranged. The pallet 13 is placed on a pallet support 23 which is provided on top of a frame 24. The frame 24 is lifted and lowered at four separate points provided with sprocket wheels 28 by means of roller chains 25. The hoisting operation is carried out by means of an electric motor 26, a shaft 17, sprocket wheels 28 and counterbalance weights 29. Weights 29 lower to take up the slack in chains 25 as the clains are lifted due to the rotation of shaft 17.

Figure 13:
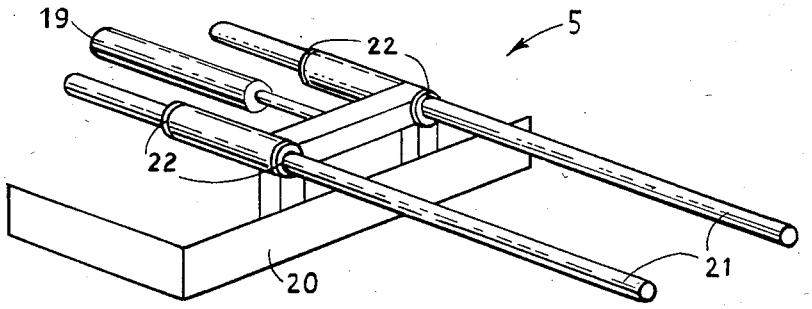
FIG. 13 illustrates the structure of the thrusting device.

The structure of the thrusting apparatus 5 is illustrated in FIG. 13. A stop plate 20 of the thrusting device 5 is guided on a shaft 21 by means of sliding sleeves 22. A pneumatic cylinder 19 can be replaced for example by an electric motor and chains for moving the sleeves 22 and thus the plate 20.

Figure 14:
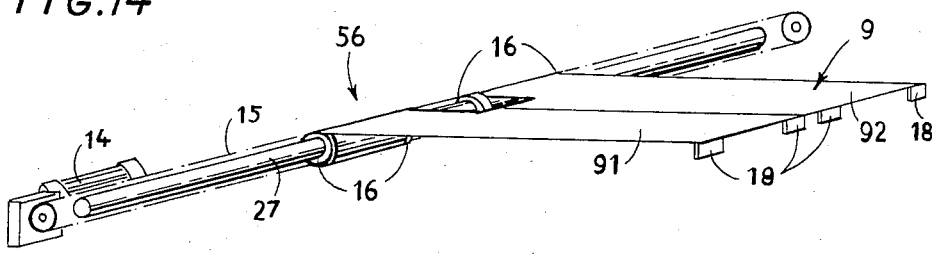
FIG. 14 illustrates the second support plate.

The shifting arrangement of the second support plate 9 is illustrated in FIG. 14. The shifting operation of the support plates 9 is carried out by means of an electric motor 14 and roller chains 15. A first part 91 of the support plate 9 is attached to the chain running above the plate and a second part 92 of the support plate 9 is attached to the chain running below the plate, which arrangement allows the two support parts 91, 92 of the plate to move in opposite directions. Both parts 91, 92 of the support plate are guided on a shaft 27 by means of sliding sleeves 16. The other ends of the parts are supported by means of sliding plates 18. The electric motor 14 can be replaced for instance by a pneumatic cylinder. It is to be noted that the parts of support plate 9 can be replaced for one support plate only the shifting operation of which is carried out principally in the same way as described above, but in one direction.

Figure 15:
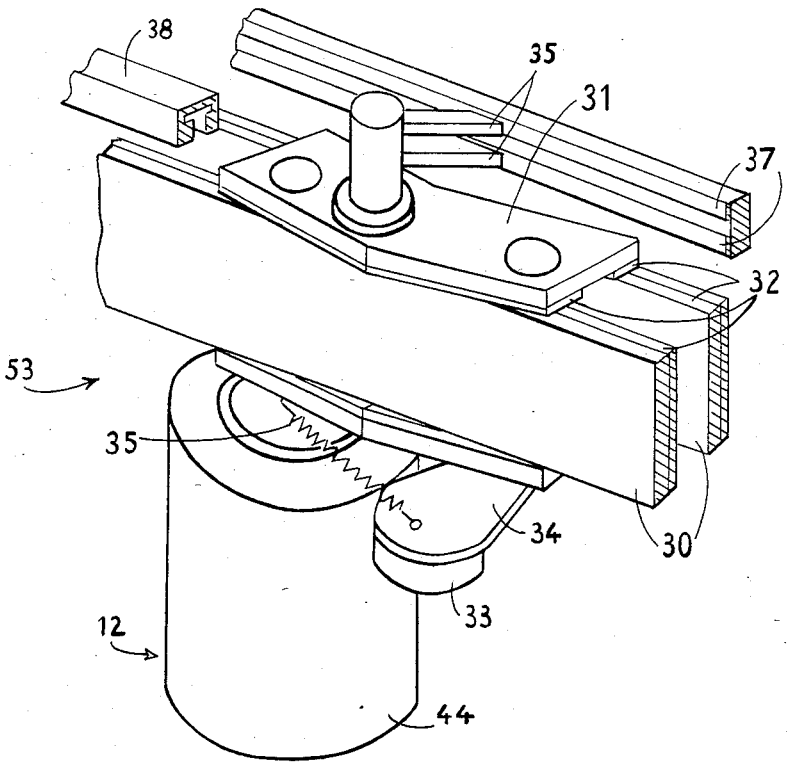
FIG. 15 illustrates the binding device.

FIG. 15 illustrates how the roller 12 is located in the wrapping frame 30. The roller 12 is installed in a cradle 31, which is guided on the wrapping frame 30 by means of sliding plates 32. The roller 12 is prevented from rotating excessively by means of a brake wheel 33 which is provided with an electromagnetic brake arrangement. The brake wheel 33 is located at the end of a lever 34. One end of the lever 34 is provided with bearings so that the brake wheel 33 can be drawn against the roller 12 with the aid of a spring 35. Electric current is conducted into the brake by means of levers 35 and brass plates 37. The movement around the wrapping frame 30 is created by employing an electric motor and a roller chain (not shown) which runs in a slide rail 38.

Figures 17A, 17B:
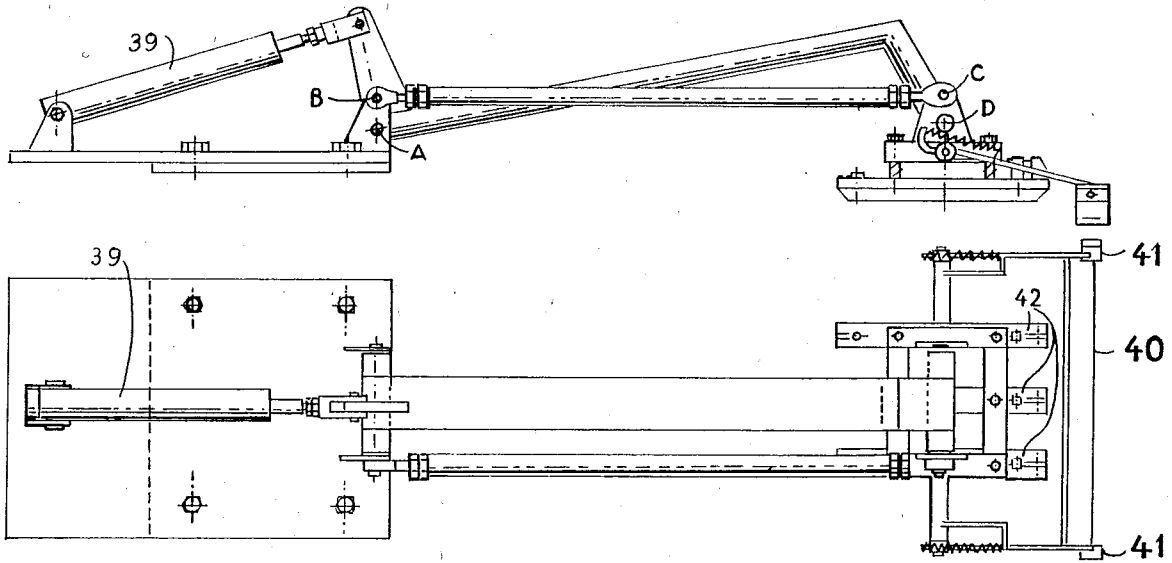
FIG. 17*a* is a side view of the cutting and seaming device.
FIG. 17*b* is a top view of the cutting and seaming device.

The structure of the cutting and seaming device 57 of the wrapping material 44 is illustrated in FIGS. 17*a* and 17*b*. With the aid of an articulated quadrangle ABCD actuated by a pneumatic cylinder 39, a position of the cutting wire 40 and its resistors 41, as well as the position of seaming resistors 42 with respect to the plastic band can be automatically regulated.

Figure 18A:
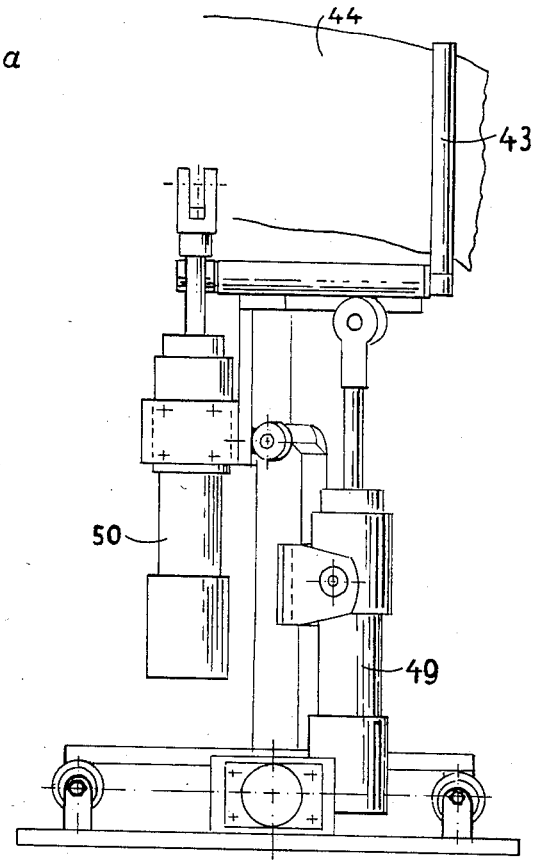
FIG. 18*a* is a side view of the gripper.
Figure 18B:
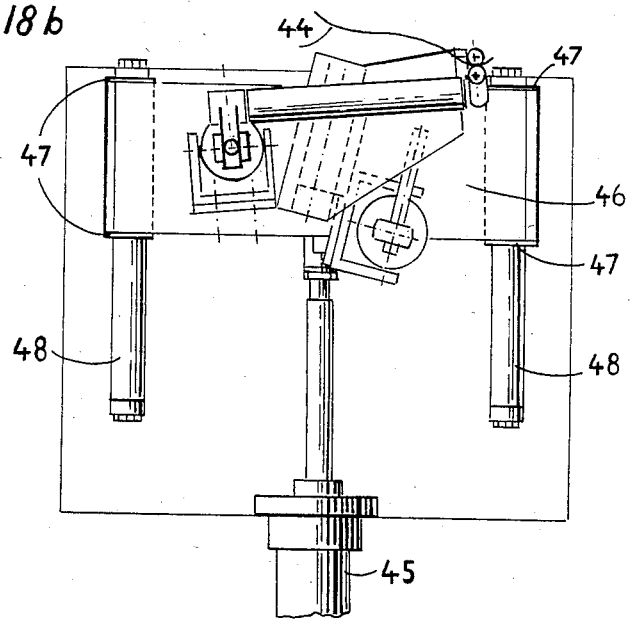
FIG. 18*b* is a top view of the gripper.

FIGS. 18*a* and 18*b* illustrate a gripper 43, the function whereof is to grip the wrapping 44 before cutting. This operation insures that the band end does not escape after cutting. Three pneumatic cylinders serve as actuators. One of the cylinders 45 moves a cradle 46 nearer to the wrapping material roll. The cradle 46 is guided on a shaft 48 by means of sliding sleeves 47. The second cylinder 49 is used for inclining the gripper 43 into horizontal position, and a third cylinder 50 provides for the opening of the gripper 43. The wrapping material band 44 is gripped so that first the gripper 43 is in horizontal position, and the cradle 46 can be pushed below the plastic band 44 by means of the cylinder 45. Thereafter the cylinder 49 hoists the gripper 43 into vertical position, and finally the gripper is wrenched together by means of the cylinder 50.

The wrapping of the packings in the above described embodiments of the packing method can be carried out so that the guide frame 11 and the pallet 13 rotate around their axes (direction D), whereas the binding device 53 is fixedly mounted on its place.

Figure 19:
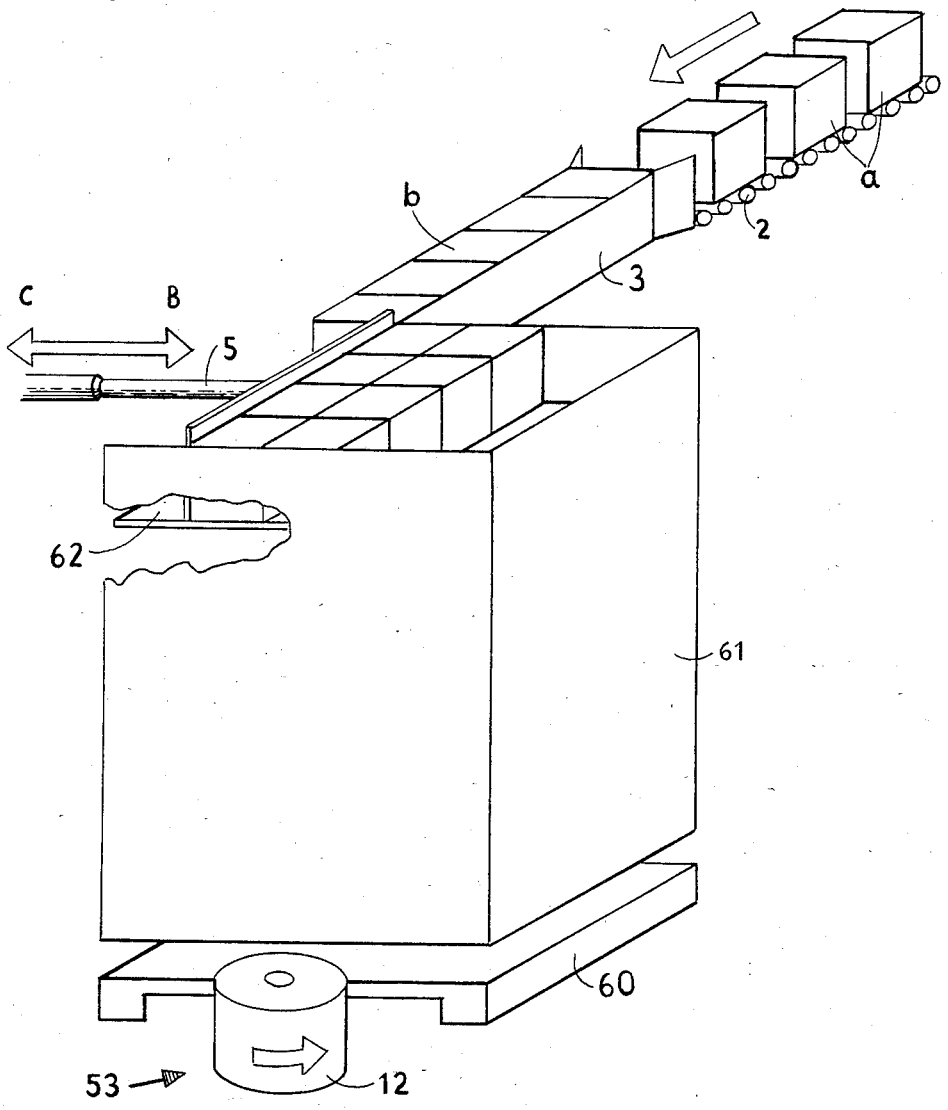
FIG. 19 illustrates the principle of the loading operation in the case where the pallet remains in a fixed position.

The loading operation, for example, can also be carried out so that the pallet 60 remains at the same standard height during the whole loading operation (FIG. 19). In that case the height of the guide frame 61 equals the amount of the desired load layers, i.e. it is a plurality of the said load layers, for instance ten load layers. One support plate moves within the guide frame 61 which is open at one side. The load layer is formed on the pallet preferably at the height of the uppermost possible load layer. After completing one load layer, the support plate 62 is lowered on top of the pallet 60 or on top of the uppermost load layer located on the pallet, whereafter the support plate 62 is removed so that the load layer is set on its place.

Thereafter the guide frame 61 is lifted the height of one load layer, and the support plate 62 is shifted upwards in order to form the next load layer. The operation of the binding device 53 of the pallet load is started when the load layer appears from below the bottom edge of the guide frame 61. The described sequences of operation are repeated until the desired amount of load layers, or such an amount as is possible when employing the guide frame in question, is achieved.

It is pointed out that the mounting height of the conveyor 2, as well as the height of the thrusting device 5, can be regulated according to the needs of each case. This arrangement provides for the regulation of the height for forming the load layers.

Furthermore, the forming of the load layer can also be carried out in some other fashion. Similarly the wrapping material can be provided for instance from rollers rotating around horizontal axes and heat-seamed at the edges. The wrapping material can also be for instance shrink-wrap.

In the above specification, the invention has been explained with reference to one preferred embodiment only. It is naturally clear that the scope of the invention is not limited to the said embodiment, but it can be modified in several different ways without departing from the appended patent claims.

I claim:

1. A packing method for packing consumer packages (a) directly onto a pallet (13) in which the packages are arranged on a support plate (9) to form a load layer (c), which load layer is supported on the sides by means of a guide frame (11) and wherein the support plate (9) is removed, so that the load layer (c) is immediately slid onto one of an empty pallet located below the support plate, and a previous load layer located on the pallet (13), and the pallet (13), together with its load layers, being lowered by the height of one load layer, characterized in that the packages are wrapped with a final wrapping material (44) simultaneously as new packings emerge from below the guide frame (11) and that the wrapping material (44) is spread so quickly that a whole load layer (d) has not totally appeared from below the guiding frame before it has already been wrapped.

2. An apparatus for applying the method of claim 1, the said apparatus consisting of a conveyor (2) for transporting the packages (a), means (5) for forming the load layer, means for supporting and gradually lowering the pallet (54), a guide frame (11), the form of which conforms to that of the load layers (c) formed by the packages to be loaded onto the pallet (13) and a support plate (9) located within said guide frame (11), onto which support plate (9) the load layer (c) is provided, an which plate (9), after the load layer (c) is formed, can be shifted aside so that the new load layer slides on top of the pallet or the previous layer, characterized in that the apparatus further comprises means (53) for continually spreading a wrapping material (44) on the outer surface of a load layer (d) before a top edge of said layer has totally emerged from below the guide frame (11) while the pallet (13) is lowered.

3. A packing method for packing consumer packages (a) directly onto a pallet (60), which packages are arranged on a support plate (62) to form a load layer, which load layer is supported on its sides by means of a guide frame (61) and wherein the support plate (62) is drawn aside, so that the load layer slided onto one of an empty pallet (60) placed at a standard height below the support plate (62) and the top of a previous load layer located on the pallet, characterized in that the guide frame (61) is lifted up the height of one load layer and simultaneously, as new packings emerge from below the support frame (61), the packings are wrapped in the final wrapping material (44).

4. An apparatus for applying the method of claim 3, said apparatus consisting of a conveyor (2) for transporting the packages (a), means (5) for forming the load layer, means for supporting the pallet (60), a guide frame (61), the form of which conforms to that of the load layers formed by the packages to be loaded onto the pallet, and a support plate (62) located within said guide frame, onto which support plate the load layer is provided and which support plate (62), after each load layer has been formed, can be shifted aside so that the load layer slides onto the empty pallet below or on top of the previous layer located on the pallet, characterized in that the apparatus further comprises means (53) for continually spreading a wrapping material (44) on the outer surface of a load layer before a top edge of said layer has totally emerged from below the guide frame (61) while it is lifted.

5. The apparatus of claim 2 or 4, characterized in that the means for spreading the wrapping material (53) comprises at least one roller (12) rotating around one roughly vertical axis, on which roller (12) the wrapping material (44) is stored in the form of a band, and which roller can be rolled around the guide frame (11).

6. The apparatus of claim 2 or 4, characterized in that the means for spreading the wrapping material (53) comprises at least one fixedly mounted roller (12) rotating around a roughly vertical axis, on which roller (12) the wrapping material (44) is stored in the form of a band, and wherein the guide frame (11) and the pallet (13) can be rotated around their axes.

7. A method of arranging packages on a pallet comprising:

providing a support plate at a selected level and at least partly surrounding guide frame having a selected height;

aligning packages on the support plate in a load layer with the guide frame at least partly bounding the layer;

positioning a pallet below the plate;

removing the plate to discharge the load layer onto the pallet;

lowering the pallet with load layer to clear the plate level;

repositioning the plate above the pallet at the plate level;

aligning packages in a further load layer on the plate;

removing the plate to discharge the further layer onto the first mentioned layer carried on the pallet;

moving one of the pallet and guide frame so that the further layer clears the plate level at a lower edge of the guide frame; and before each load layer on the pallet clears the lower edge of the guide frame, simultaneously wrapping the load layers on the pallet with wrapping material.

8. A method according to claim 7, comprising providing the wrapping on a roll having a substantially vertical axis and wrapping the load layers by unrolling wrapping from the roll onto an outer periphery of the load layers.

9. A method according to claim 8, comprising wrapping the outer periphery of the load layers by rotating the load layers with the pallet and the guide frame.

10. An apparatus for positioning packages on a pallet comprising:

a support plate for receiving a plurality of packages in a load layer thereon at a selected plate level;

a guide frame at least partly surrounding said support plate for bounding and guiding each load layer;

means for positioning a pallet under said plate level;

means for aligning a plurality of packages on said support plate in a load layer;

means for removing said support plate for discharging each load layer onto said pallet;

means for lowering said pallet to provide room for said pallet to receive additional load layers from said support plate;

means for changing the relative vertical level of said pallet with at least one load layer and said guide frame for exposing the at least one load layer below a lower edge of said guide frame; and means for wrapping an outer periphery of each load layer as it emerges from below said guide frame wrapping material;

said means for wrapping load layers comprising a roll of material mounted for rotation about a substantially vertical axis below said guide frame and means for rotating one of said roll and said pallet with load layers and said guide frame, for causing the material to wrap the load layers before the at least one load layer has moved below the lower edge of said guide frame.

* * * * *